US006412765B1

(12) United States Patent
Blakeley

(10) Patent No.: US 6,412,765 B1
(45) Date of Patent: Jul. 2, 2002

(54) MANDREL MECHANISM FOR TIN BOX MANUFACTURING APPARATUS

(75) Inventor: Ian Anthony Blakeley, West Yorkshire (GB)

(73) Assignee: Meltog Ltd., Birstall (GB)

( * ) Notice: Subject to any disclaimer, the term of this patent is extended or adjusted under 35 U.S.C. 154(b) by 0 days.

(21) Appl. No.: 09/676,553

(22) Filed: Sep. 30, 2000

(30) Foreign Application Priority Data

Sep. 30, 1999 (GB) ..... 9923205

(51) Int. Cl.[7] ..... B23Q 3/14
(52) U.S. Cl. ..... 269/48.1
(58) Field of Search ..... 269/48.1, 43; 72/393; 228/49, 44.5, 45; 279/2 R; 29/243.5

(56) References Cited

U.S. PATENT DOCUMENTS 3,750,451 A * 8/1973 Nolan ..... 269/48.1
4,337,932 A * 7/1982 Dennis et al. ..... 269/48.1
4,767,125 A * 8/1988 Barry et al. ..... 269/48.1
4,881,745 A * 11/1989 Peters ..... 269/48.1

* cited by examiner

*Primary Examiner*—Robert C. Watson

(74) *Attorney, Agent, or Firm*—Bell, Boyd & Lloyd LLC

(57) ABSTRACT

A mandrel for use in tin box manufacturing apparatus is described. The mandrel is provided with a base component and a plurality of side wall components which are indirectly coupled to said base component such that the movement of said base component towards the center of said mandrel causes laterally outward displacement of said side wall components. The coupling is achieved by connecting a rod member to the base component which moves vertically within the mandrel when the base component moves and providing inclined cam surfaces on either side of said rod member against which cam followers provided on lateral actuating members are springingly biased. The cam surfaces of the rod member and the actuating members are ideally disposed within the mandrel in a plane parallel with the base component and at the mid point of the depth of the mandrel. On either side of the actuating members and optionally at the end thereof, secondary angled cam surfaces are provided against which cam followers coupled to the side wall components and optionally corner components of the mandrel are springingly biased. In use, the base component is forced inwardly of the mandrel, the rod member moves vertically upwardly as do the inclined cam surfaces thereon thus causing laterally outward motion of the actuating members and their cam surfaces, which in turn causes outward motion of the side wall components in a perpendicular direction, and outward motion of the optional corner components in a diagonal direction.

11 Claims, 11 Drawing Sheets

MANDREL MECHANISM FOR TIN BOX MANUFACTURING APPARATUS

Figure 1A:
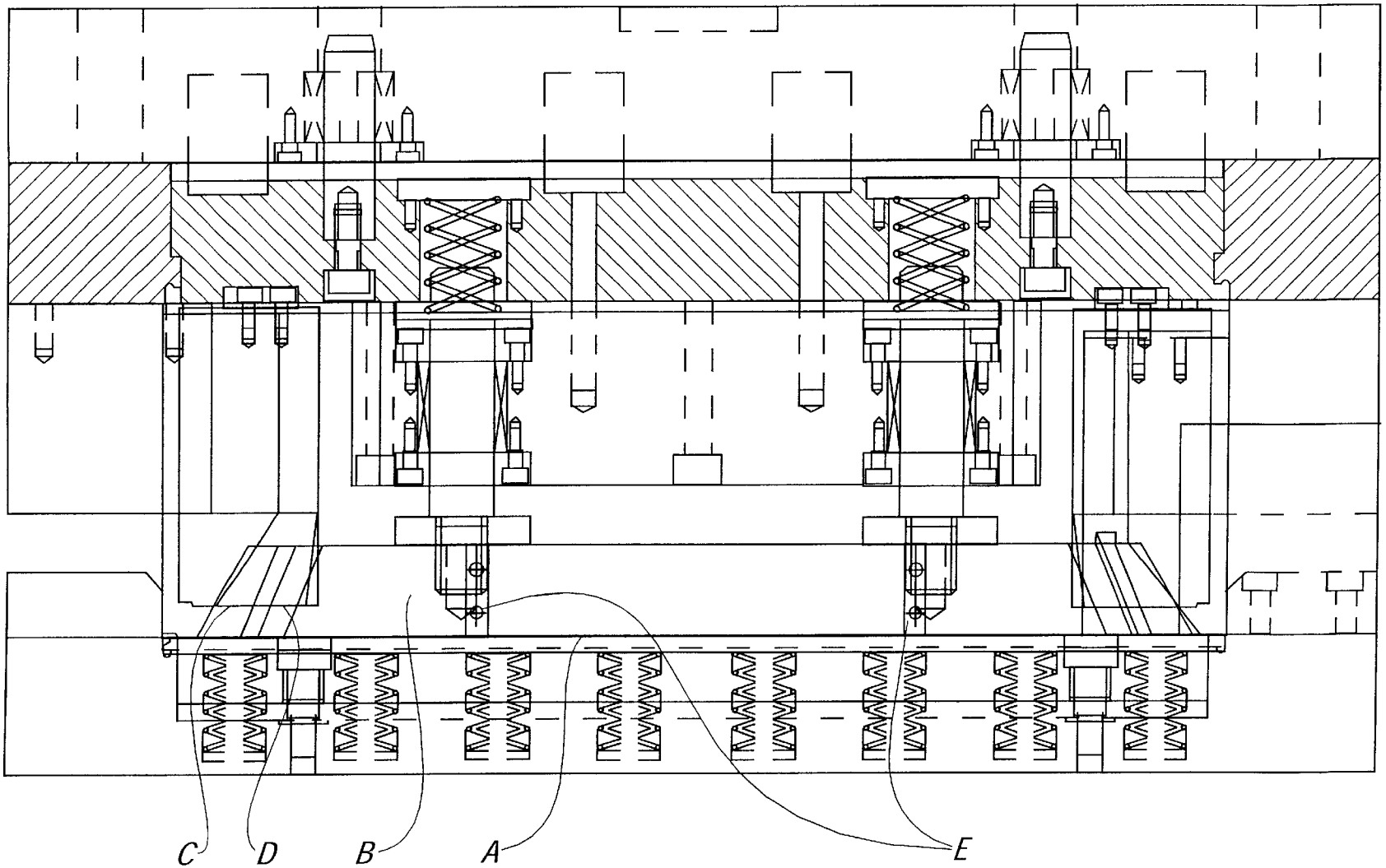

This invention relates to a mounting and locating mechanism for box manufacturing apparatus, and more specifically to a mounting block over which a hollow, end-less tin box shell is placed before an end is secured to a peripheral edge at one end of the shell. Yet more specifically, the mechanism of the present invention is particularly suited to tin box manufacturing apparatus wherein the substantially planar ends of the boxes are secured to peripheral edges of the shells by inward deformation of said edges such that the outer surfaces of the tin box walls are substantially planar in the region of the end.

It should be mentioned that in the alternative method of attaching the planar ends, end-seaming apparatus is used, the apparatus being commonly known as a round and irregular seamer. This apparatus usually comprises a plurality of seaming heads arranged equidistantly from a central axis of a mandrel having a forming surface around which one end of the end-less tin box shell is disposed. Additionally, an end is held in substantially planar contact with a face of said mandrel and the shell and end are provided with formations which at least partially interlock prior to the seaming operation. The seaming heads are brought to bear against the mandrel in the region of the interlocking formations of shell and end to compress same thus forming a seam around what is effectively the base of the tin box thus formed. It will thus be understood that the seaming operation takes place on the external surface the shell.

The present invention is most particularly suited to a different type of tin box construction wherein the end is secured to the end-less tin box shell by deformation of one of the edges of said shell internally of the tin box such by means hereinafter described.

Moreover, the present application is most applicable to apparatus for the manufacture of tin boxes having a rectangular, square, or other regular quadrilateral shape, but it is to be pointed out that the person skilled in the art will appreciate that the mechanism hereinafter described can be equally applied to tin boxes having alternative cross-sectional shapes.

Apparatus currently in use for securing an end to an end-less tin box shell comprises a expansible mandrel which is reciprocally driven into and out of a forming tool.

In general, an indexable table is provided beneath the mandrel having at least four indexable positions and a plurality of forming tools are disposed at suitable locations thereon. The forming tools consist of a rectangular block having side walls which define a cavity of a size and shape generally corresponding to that of the tin box which is to be manufactured, and a base which consists of a thrust plate springingly mounted on the table and having a rectangular or other shape groove therein which receives the partially curled edges of both the end-less shell and the end to be secured thereto in interlocking relationship. The sequence of operations during the securing of an end to an end-less shell is as follows:

In a first indexable position of the table and end-less shell having a partially curled lower edge is deposited within the tool such that said edge is received within the groove in the thrust plate, and the side walls of said shell are bounded to the outside by the walls of the forming tool.

The table is then indexed to a second position whereat an end is deposited, within the forming tool by being placed proximate the base of the tool internally of the shell. The end is ideally provided with a peripheral flange or other suitable formation which is also received in the groove in the thrust plate, the deposit of the end being so as to ensure interlocking engagement or adjacent disposition of the partial curl provided on one edge of the shell and the said formation on the end within said groove.

The table is then indexed to a third position such that the forming tool is directly beneath the reciprocally actuated expansible mandrel. The mandrel is brought down into the cavity defined by the side walls of the shell within the forming tool until the lower face of the mandrel comes into contact with the end disposed at the base of the cavity. It should be mentioned at this point that the dimensions of the mandrel are ideally marginally less than those of the shell, but that the cross-sectional shape is broadly the same. The mandrel can thus enter the cavity without interference from the side walls of the shell.

The construction of the mandrel itself is complex but to aid understanding a sectional view through and a plan view of a mandrel of prior art configuration is shown in FIG. 1, and in general it consists of a lower contact face A which behind which retreat one or more wedge components B, C, D having inclined faces which retreat inwardly of the mandrel towards its centre. Depending on the extent of expansion of the various faces of the mandrel block which is required, and its particular cross-sectional shape, the angles of inclination of the various inwardly retreating faces of the wedge components can vary.

The usually vertically orientated side faces and/or corners of the mandrel can be displaced outwardly against the action of springs which bias same towards the centre of the mandrel, and each of the four side walls will consist of a separate component, having a correspondingly inclined surface which communicates with a respective inclined surface of the wedge component from which the lower contact surface is comprised. To ensure as smooth and uniform outward displacement of the side walls of the mandrel, a plurality of T-shaped guides of a suitable low-friction, high wear metal are usually secured within grooves E, F, G, H provided on the inclined faces of the wedge components, and the correspondingly inclined portions of the side walls of the mandrel are provided with suitable grooves which receive the T-shaped formations of the guides.

Hence, when the lowermost contact surface of the mandrel is brought to bear against the thrust plate trapping the end therebetween, the side faces of the mandrel move outwardly by virtue of the vertical motion of the wedge components. The degree of expansion is dependent on the dimensions of the mandrel when contracted, and the internal dimensions of the tin box to be manufactured, but in general a small tolerance will remain between the fully expanded side walls of the mandrel and the internal surface of the side walls of the shell within the forming tool. This is to allow for correct seating of the partially curled edge of the shell within the groove on the base of the forming tool.

After the mandrel is fully expanded, the end is clamped securely in place between the mandrel and the forming tool, and the shell can move slightly in the cavity of the forming tool. At this stage, further vertical motion of the mandrel within the cavity does not cause any further expansion of the mandrel, but instead the mounting plate to which the mandrel is springingly mounted is brought to bear against the uppermost edge of the shell which stands proud of the forming tool. This occurs because the compression force provided by the springs which bias the mandrel away from the mounting plate is overcome, and as a result of the vertical force applied around the uppermost edge of the shell, the curl of the lowermost edge of said shell is completed within the groove around the corresponding and interlocked formation provided on the end, and thus the end is secured to the shell. After the completion of the curl, the mandrel is removed from the tool.

The table is then indexed to a fourth position, and the completed tin box is removed from the forming tool.

It will be immediately apparent to those skilled in the art of accurate machining of engineering components that to machine the wedge components which form the lower contact surface of the mandrel, or the T-shaped guides attached thereto, and the correspondingly inclined surfaces of the side walls of the mandrel is an exceedingly difficult task, especially considering the tolerances which must be achieved to ensure efficacious operation and repeatable, trouble free manufacture of tin boxes. Any slight differences in inclination between the surfaces of the wedge components, and the surfaces of the side wall components could cause catastrophic failure of the mandrel after repeated use.

Furthermore, when it is considered that the apparatus described may be used to manufacture many tens or even hundreds of thousands of tin boxes, material wear must be taken into account. The impossibility of predicting how the various components will wear necessarily means that continual adjustment and re-machining of the mandrel components may be required to ensure accurate operation.

A yet further disadvantage is the direction in which the forces which cause the displacement of the side walls act, i.e. perpendicular to the inclined surfaces of the various components, and the fact that the displacement of the side walls is impeded by the friction between respective components. Firstly, the force causing the displacement not only causes displacement of the side walls by virtue of the force component acting parallel to the direction of the displacement, but there is also a perpendicular force component which serves to pressurise the connection between the side wall of said mandrel being displaced and the mandrel itself. Secondly, as the force causing the displacement of the side walls is applied close to the bottom of said side walls, there is a couple which exerts a torque about the connection of side wall to mandrel and therefore can cause a rotation of the side wall component.

It will be seen that the current expanding mandrel configuration is entirely unacceptable, and it is an object of this invention to provide an expanding mandrel which is not prone to significant wear, which ensures that unwanted force components and torques are minimised during expansion, if not eliminated.

It is a further object of this invention to provide an expansible mandrel the side walls of which expand in a uniform, reliable and repeatable manner without a requirement for excessively intricate or precise machining of components.

In one aspect of the invention, it is a yet further object thereof to provide an expansible mandrel, the side wall and/or corner components of which can be displaced simultaneously outwardly at a uniform rate such that the ratio of the distance of points on the outer surface of the components from the geometric centre of the cross-sectional shape of the mandrel when expanded, the said points being in the same horizontal plane, to the distance of those points from the geometric centre of the cross-sectional shape defined by the mandrel when contracted is the same for all points. In this manner the cross-sectional shape of the mandrel is purely enlarged as opposed to being distorted.

It is a further object of the invention to provide an expansible mandrel which can replace existing expansible mandrels.

It is a yet further object of the invention to provide a method of expanding mandrels and like components in a uniform manner.

According to the invention there is provided an expansible mandrel of a required depth having at least three side wall components movably coupled thereto and a movable base component, the outer surfaces of said side wall components defining a cross-sectional shape of said mandrel which it is desired to expand and contract in a predetermined manner, said base component mechanically communicating with said side wall components such that motion of said base in one direction causes motion of said side wall components in a direction perpendicular to said one direction to expand or contract said cross-sectional shape, characterised in that the mechanical communication between base and side wall components is indirectly achieved through a first member connected to said base component to be movable therewith and extending internally of said mandrel away from said base component and generally in the direction of movement thereof, said first member having at least one cam surface on a side thereof remote from the connection with the base component and against which a cam follower of an actuating member bears, said actuating member being in communication with at least one of said side wall components to move same in a direction perpendicular to the movement of said first member.

Preferably said actuating component is disposed substantially at the mid point of the depth of the mandrel and is substantially parallel with the base.

Preferably the first member is provided with a pair of cam surfaces, and two actuating members are disposed on either side of said first member and orientated substantially perpendicular thereto, both being provided with cam followers bearing against the cam surfaces and apart and towards each other when the first member moves up and down within the mandrel.

Further preferably, the actuating members are provided with cam followers on at least one side and said side wall components are coupled with cam followers which bear against said cam surfaces resulting in motion of said side wall components in a substantially perpendicular direction to the motion of said actuating component.

Preferably the cam surfaces and the cam followers are inclined to the longitudinal axes of said first member and said actuating member respectively and are in parallel contact with each other such that the motion of the first member causes wedging lateral displacement of said actuating members whose motion in turn causes wedging outward displacement of said side wall components.

Most preferably the first member is substantially centrally disposed within the mandrel.

Preferably the actuating members are displaced laterally towards the extremities of the mandrel when the motion of the first member is vertically upward within said mandrel.

Preferably the vertically upward motion of the base and the first member, the concomitant lateral motion of the actuating members and the outward motion of the side wall components occurs against spring biasing means which ensure that the side wall components and the actuating members are returned to their original positions when the base of the mandrel is no longer forced inwardly thereof.

Preferably said cam followers include rollers pivotally mounted in said actuating members and said side wall components which contact the cam surfaces of the first member and of the actuating member respectively.

This is the most desirable arrangement because in this instance the expanding force is applied to the actuating member and thence to the side wall components directly through the pivot from the line of contact of the roller with the cam surface. Additionally, frictional forces are minimised. However, the pin about which the roller pivots in its mounting during motion of the various components is subjected to a significant shear force, and in most cases the most suitable arrangement is to provide the cam followers in the form of wedges which bear against the cam surfaces over a predetermined area. The sliding motion of the cam follower over the cam surface as the latter moves causes the outward displacement of the cam follower and although frictional forces between the two can become significant, they can always be overcome if suitable durable and low friction materials are used on cam surface and the cam follower.

Preferably the outward displacement of the side wall components is uniform ensuring that the cross-sectional shape of the mandrel is not distorted during expansion.

Preferably the cam followers are circular, and the base component is separate from the base of the member.

Where the mandrel is quadrangular and preferably rectangular, it is further preferable that the ends of the actuating members are provided with secondary cam surfaces on either side of the longitudinal axis of the rod, against which secondary cam followers are biased, said secondary cam followers being coupled to corner components to effect motion thereof in a diagonally outward direction during expansion of the mandrel.

It will be immediately appreciated by those skilled in the art that the disposition of the cam followers and cam surfaces of the various components in a plane parallel with the base and at approximately the mid-point of the depth of the mandrel ensures a smooth and uniform expansion of the mandrel as a whole, and also ensures that the cross-sectional shape defined by the outer surfaces thereof expands proportionally correctly without distortion or differential displacement over the depth of individual side wall and corner components.

Figure 1B:
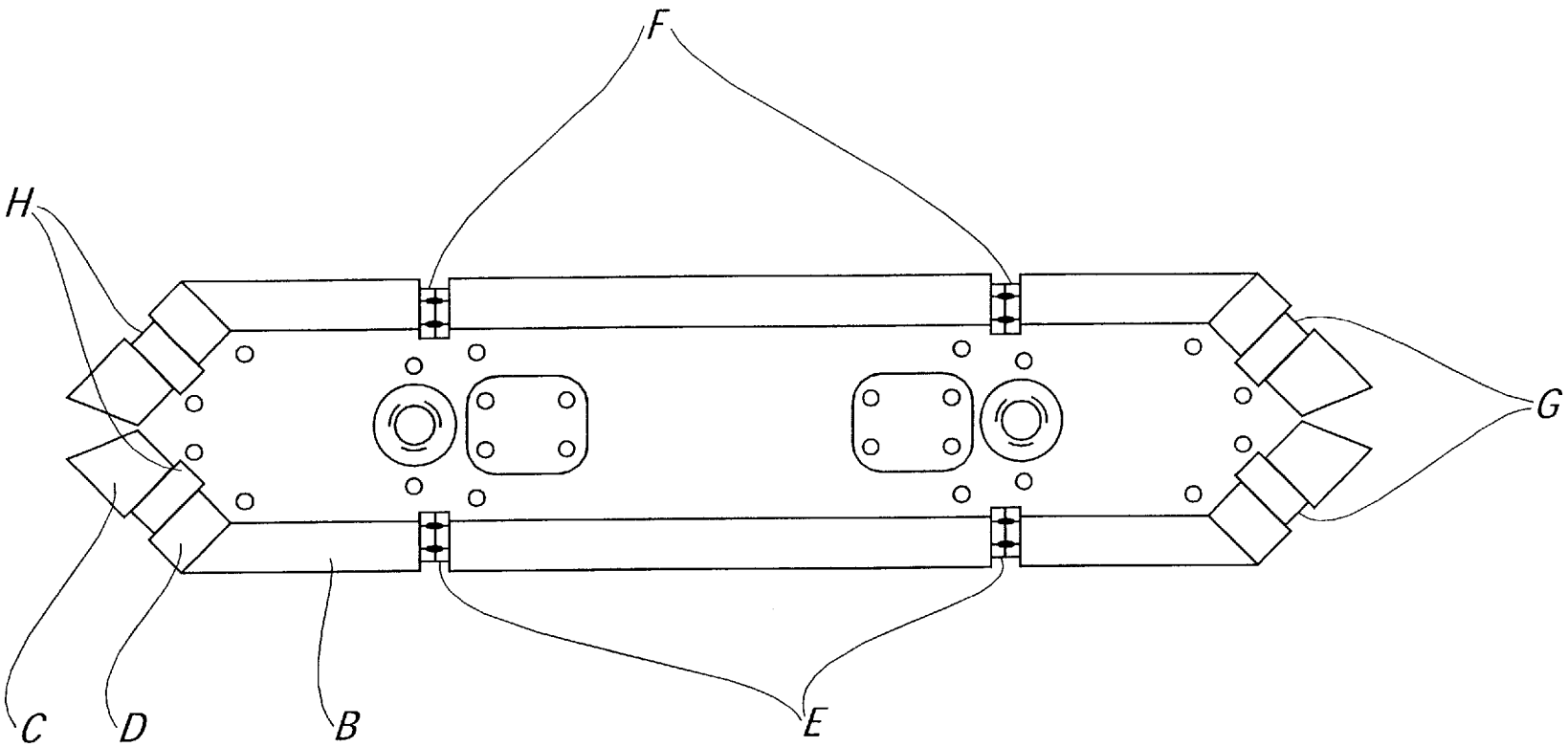
Figure 1C:
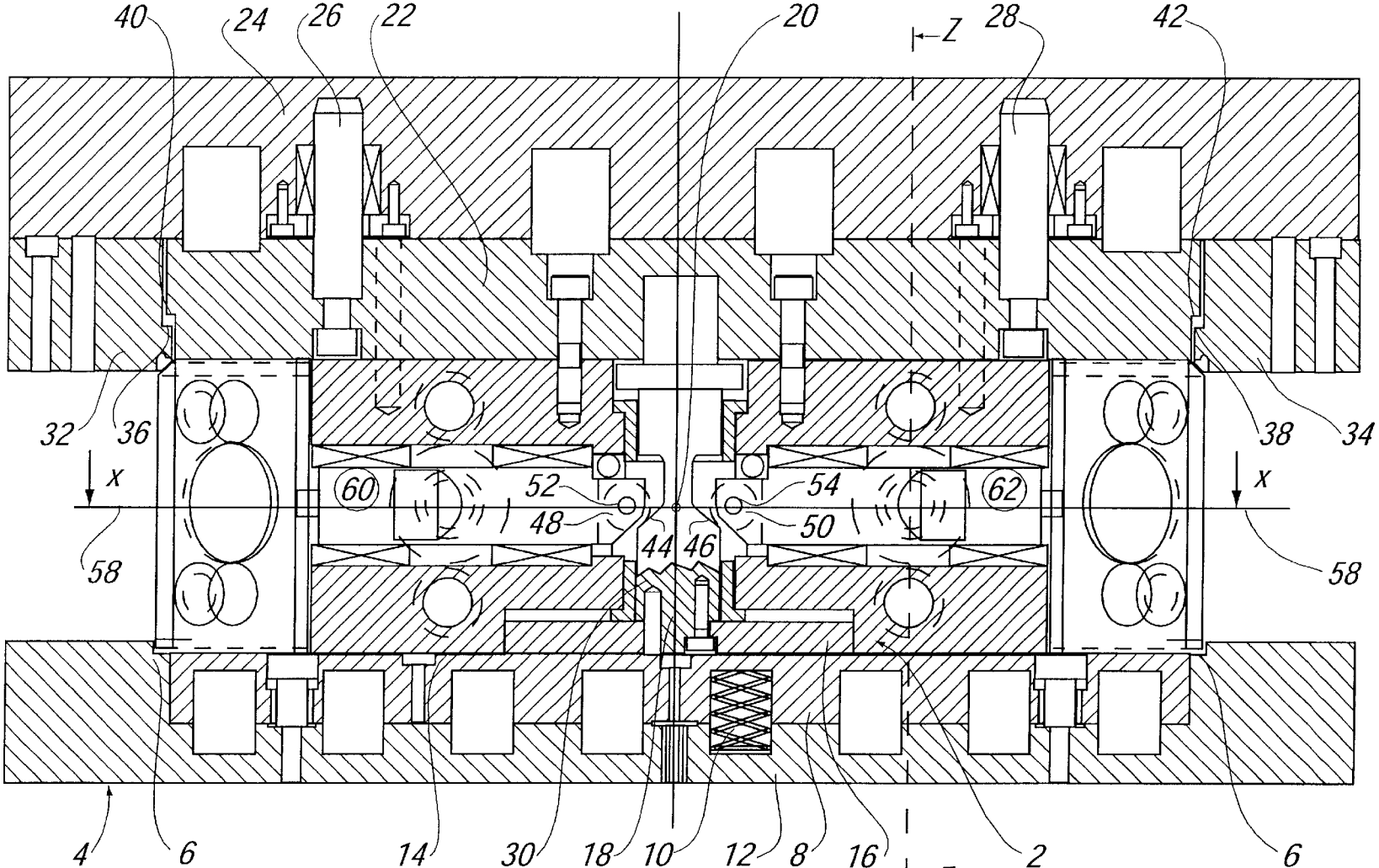
Figure 2:
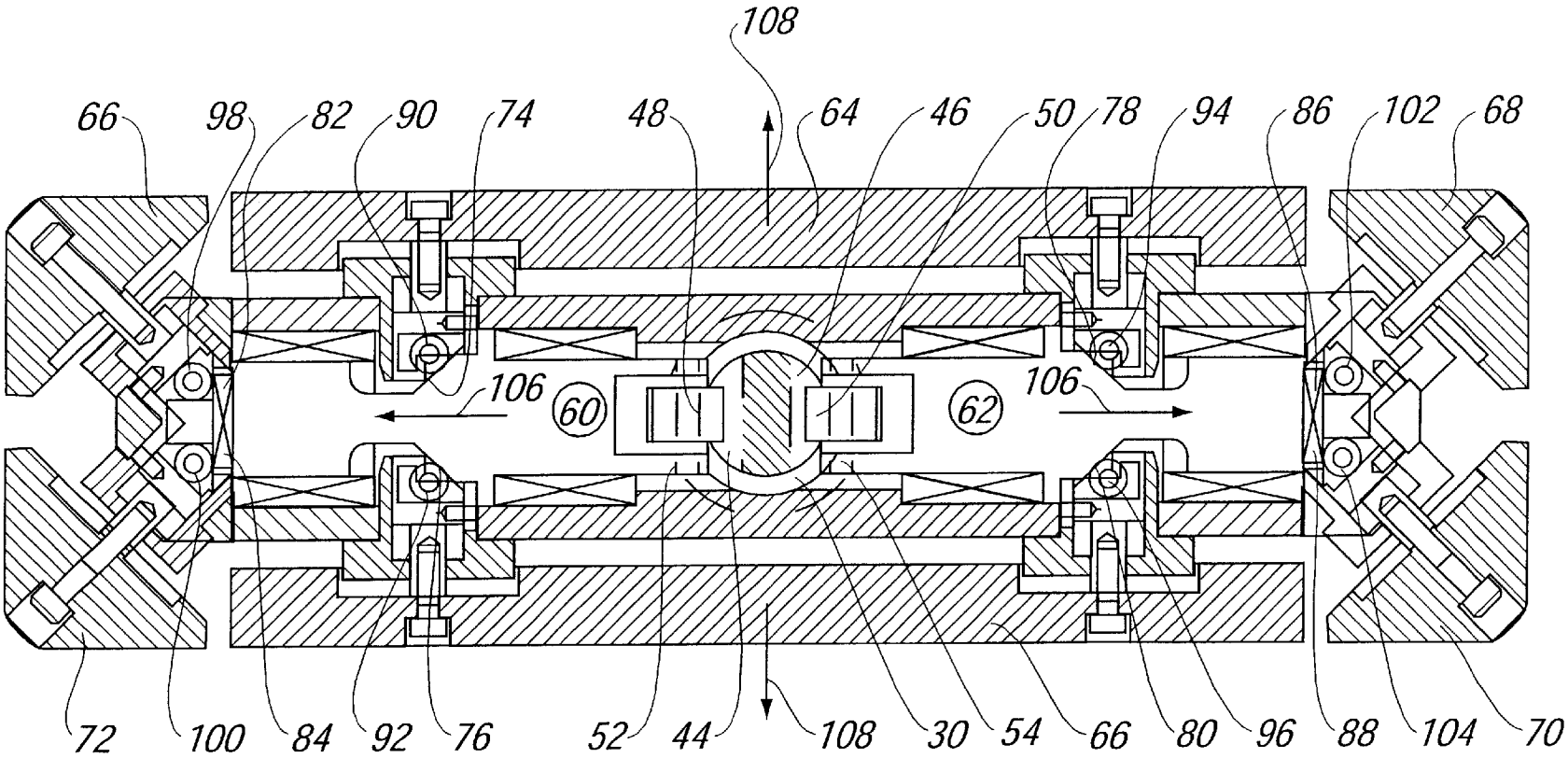
Figure 3:
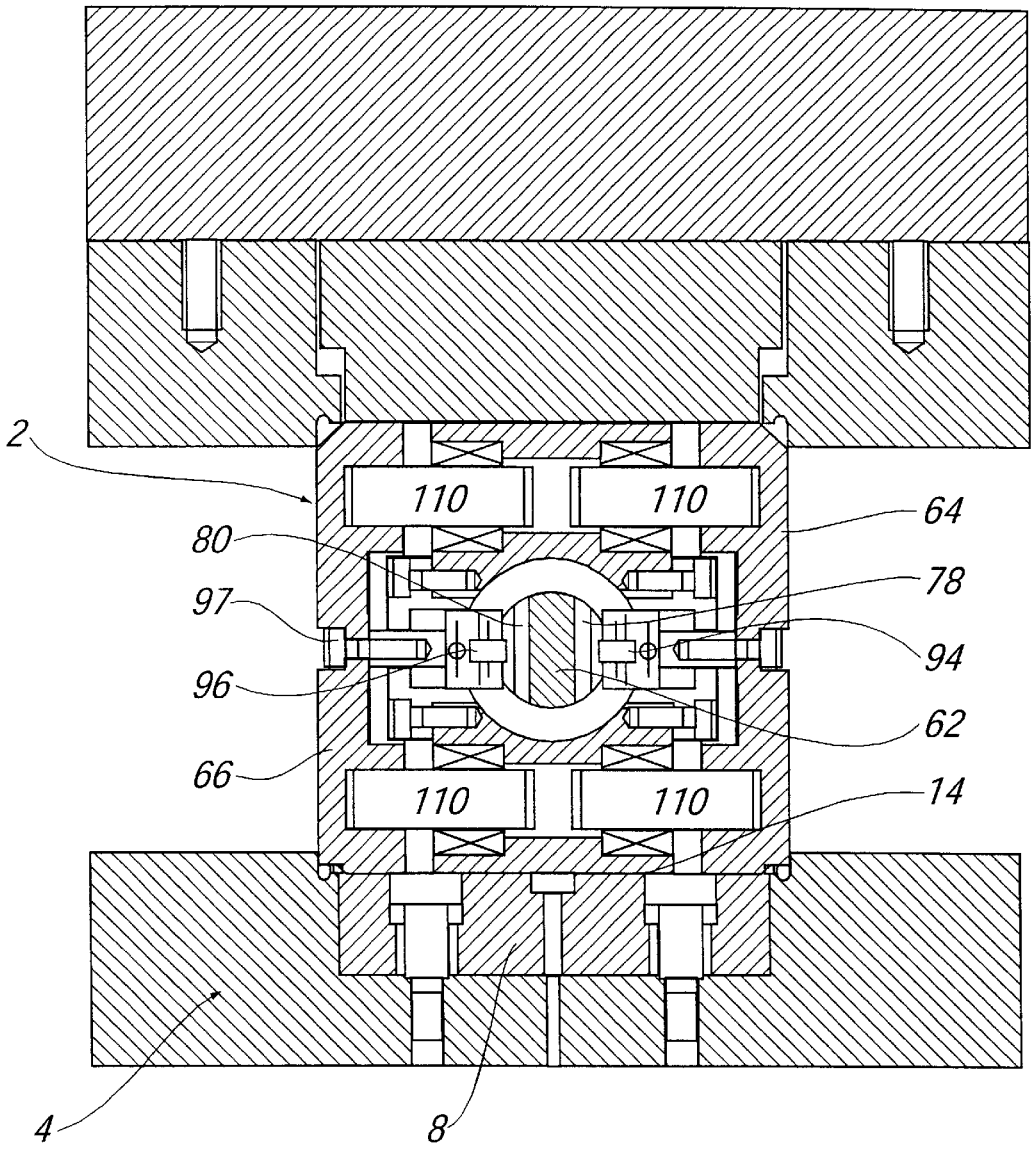
Figure 4:
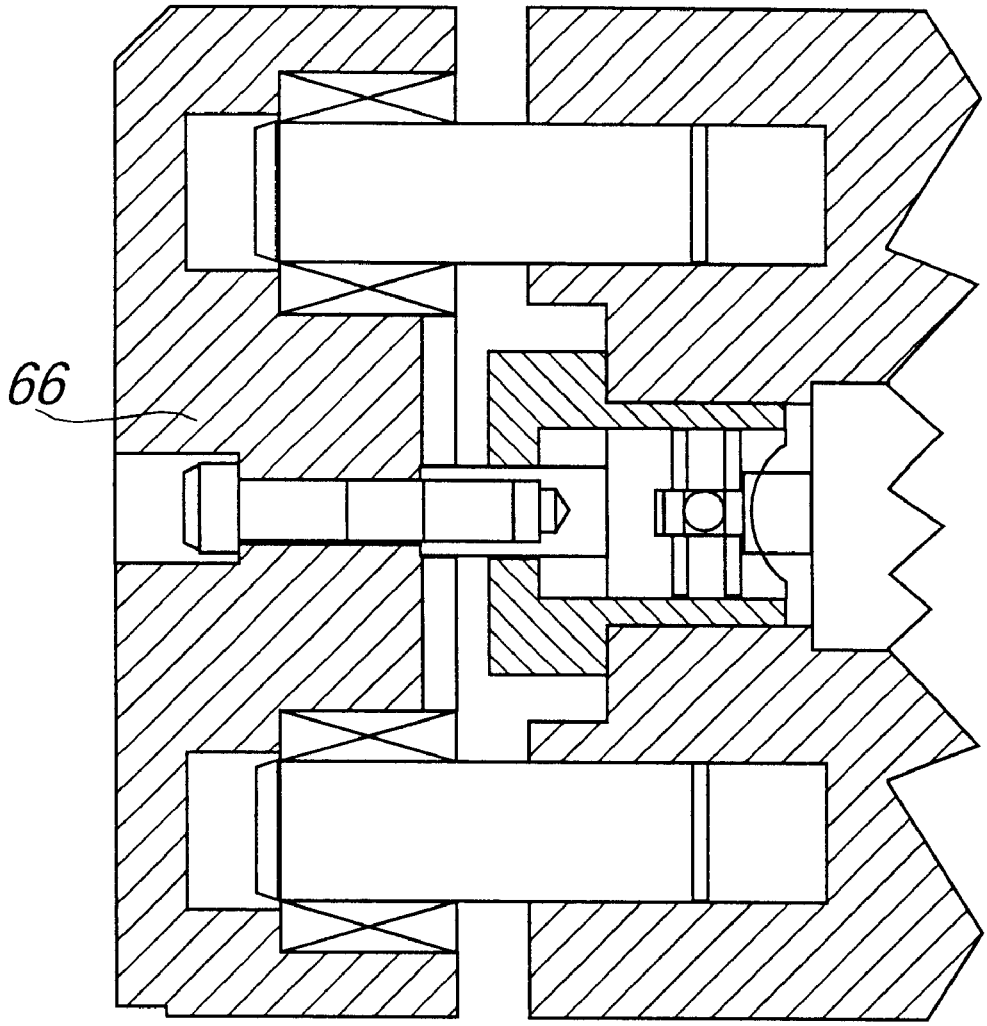
Figure 6:
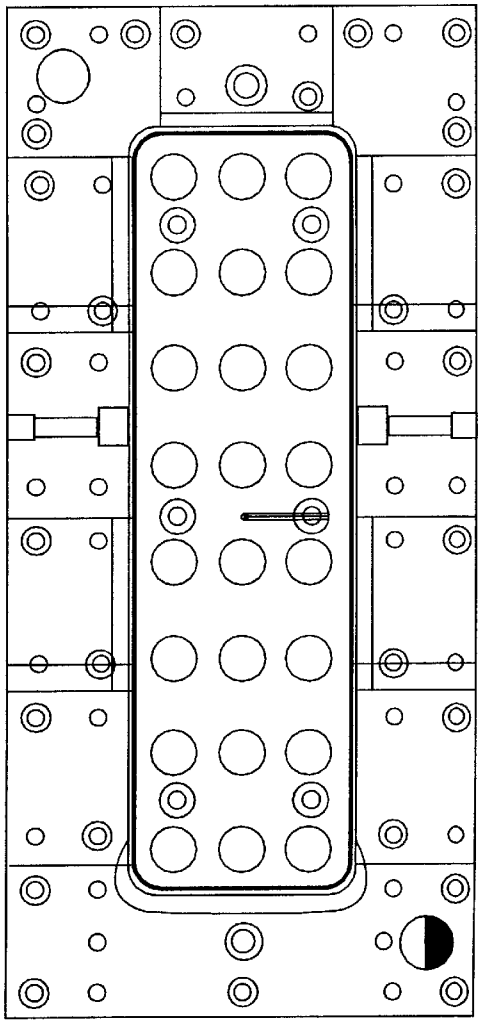
Figure 5:
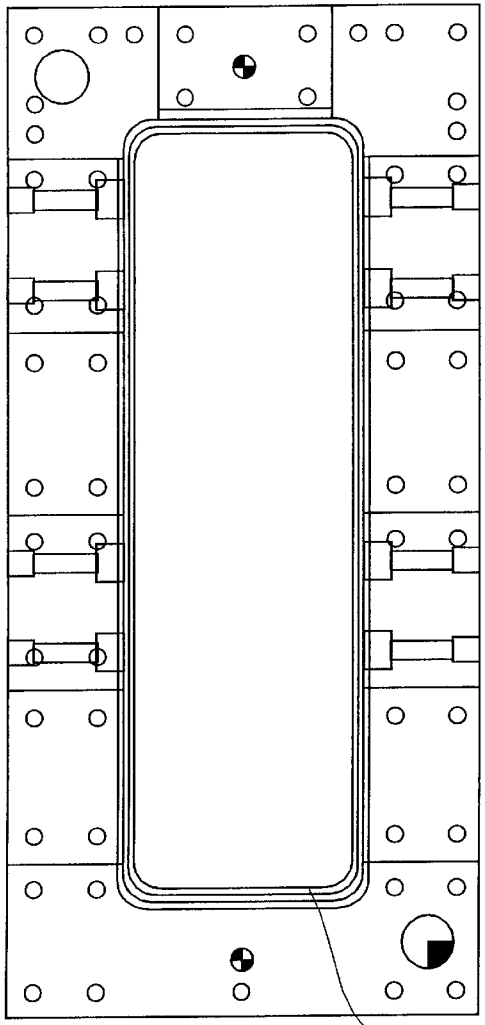
Figure 7:
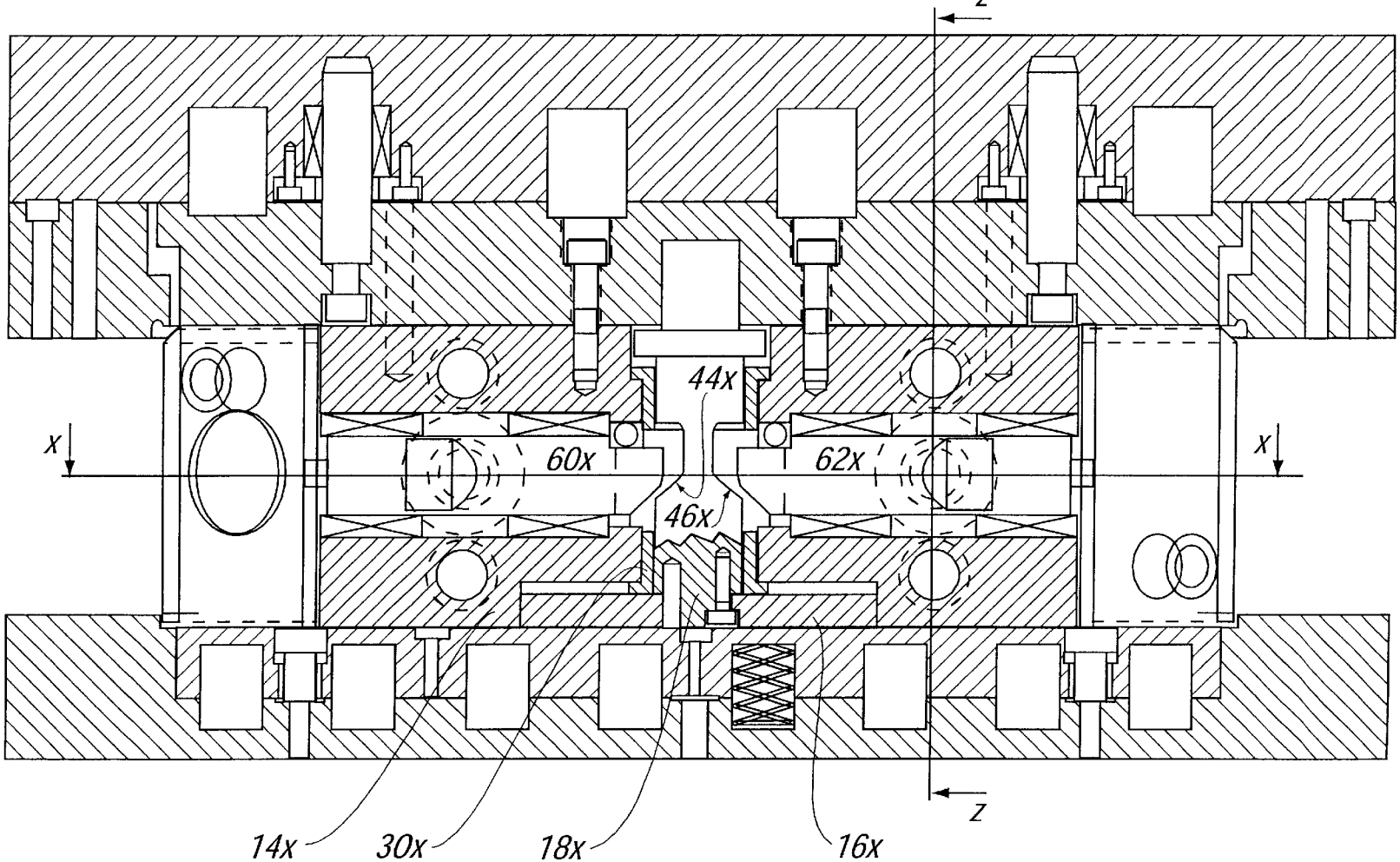

A specific embodiment of the invention is now described by way of example with reference to the accompanying drawings wherein FIGS. 1A, 1B show respectively a sectional view through a mandrel of prior art configuration and a plan view of the base of a mandrel of prior art configuration, FIG. 1C shows a vertical section view through the mandrel of the present invention while in place within a forming tool, FIG. 2 shows a horizontal sectional view of the mandrel of FIG. 1A on X—X FIG. 3 shows a vertical sectional view on the line Z—Z of FIG. 1C FIG. 4 shows a sectional view on Y—Y in FIG. 2, FIGS. 5, 6 show plan views of the top and bottom respectively of this forming tool in which the mandrel of Figure is seated, and FIG. 7 shows a vertical section view through the mandrel of the present invention according to the aspect of the invention utilising wedge shaped surfaces.

Figure 8:
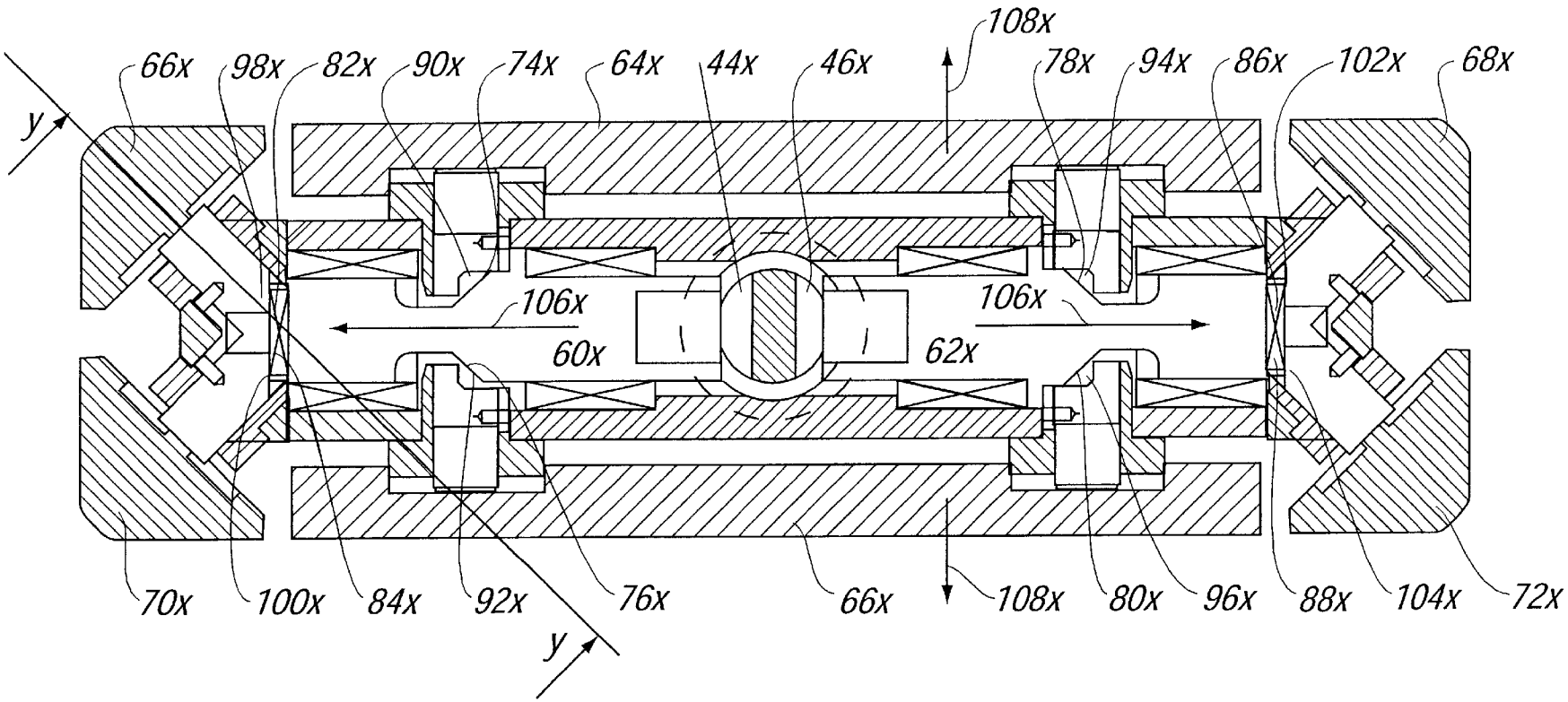
Figure 9:
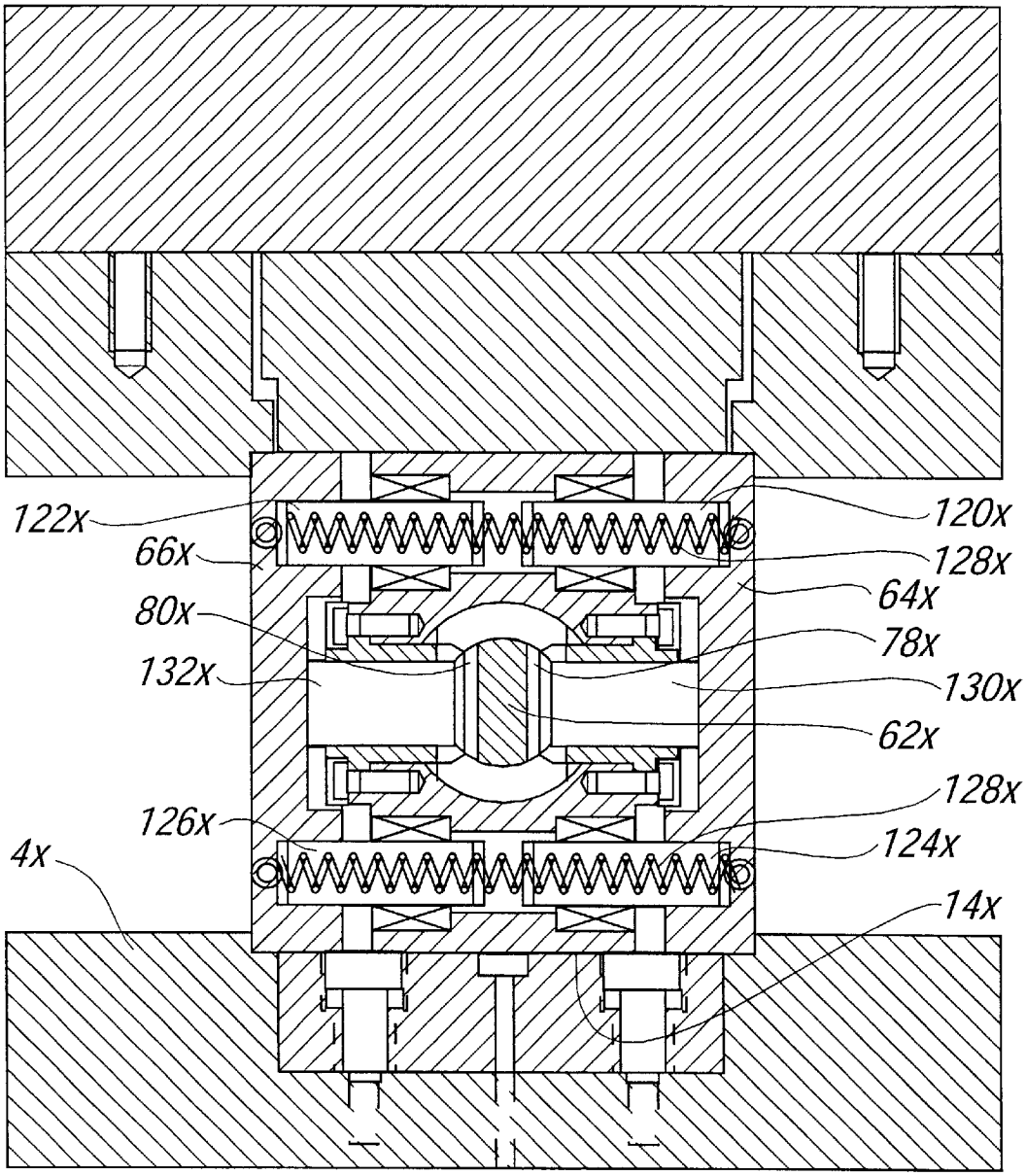
Figure 10:
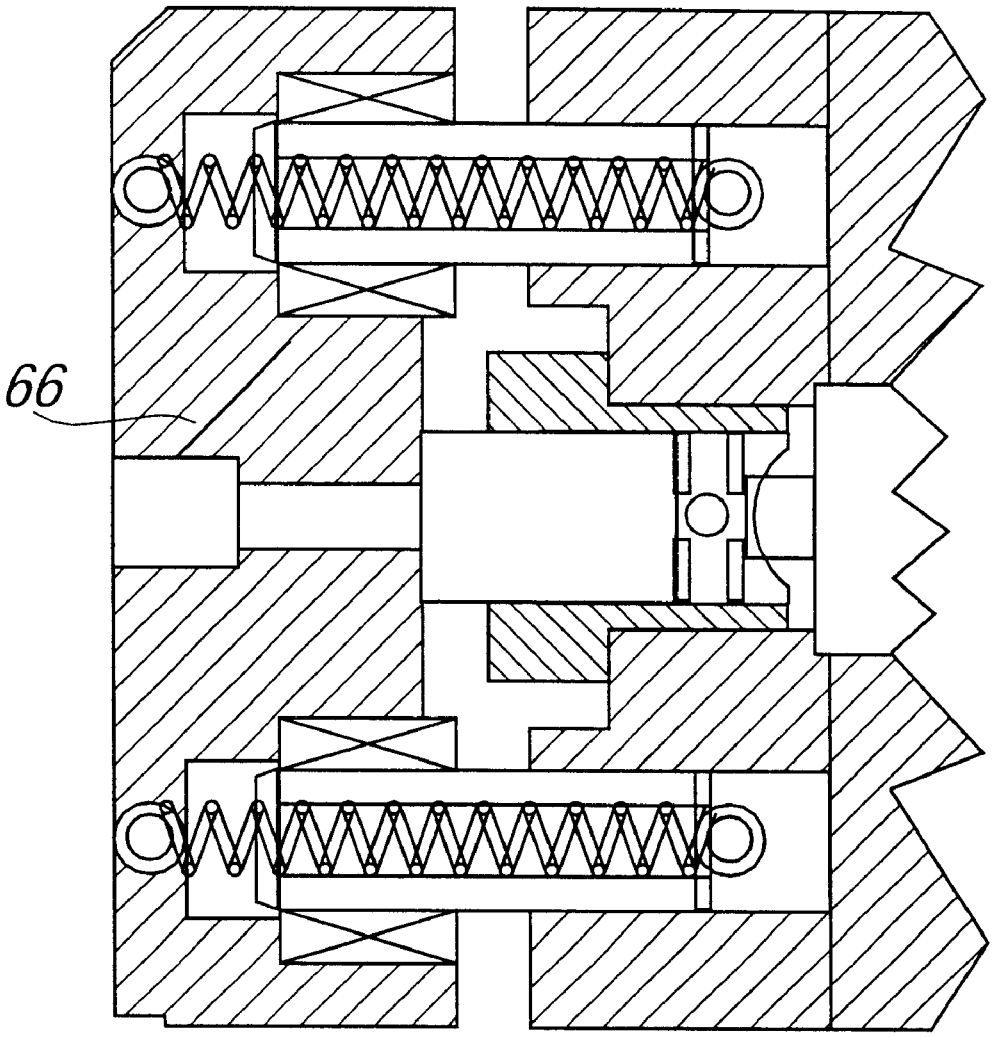

FIG. 8 shows a horizontal sectional view of the mandrel of FIG. 7 on X—X FIG. 9 shows a vertical sectional view on the line Z—Z of FIG. 7, and FIG. 10 shows a sectional view on Y—Y in FIG. 8.

Referring firstly to FIG. 1C there is shown a expansible mandrel 2 seated within a forming tool indicated generally at 4 (the walls of said forming tool are not shown for the purposes of clarity) having a continuous groove 6 which can receive the partial curl provided around one peripheral edge of an end-less tin box shell, and interlocked therewith the flange provided around the edge of an end to be secured thereto (neither shown).

The forming tool 4 is provided with a thrust plate 8 mounted on springs 10 to a carrier 12, and the mandrel lower surface 14 consists essentially of a base plate 16 which is capable of vertical movement towards a notional centre 20 of the mandrel along a vertical axis 18 thereof.

The mandrel 2 is mounted on a carrier plate 22 which is in turn springingly mounted on a backing plate 24 at mountings 26, 28 which rotolin shafts and bearings. The base plate 16 is connected to a cam component 30 which is springingly biased towards the lower surface 14 of the mandrel such that when the mandrel is withdrawn from the forming tool, the base plate 16 stands proud of said lower surface 14 by a suitable amount.

The spring constants of the various springs used in the entire arrangement are chosen such that when the mandrel is moved within the forming tool and the base plate 16 comes into contact with the thrust plate 8, said base plate and thus said cam component 30 are move vertically upwardly within the mandrel. As the backing plate 24 continues its vertically downward motion, the force of the spring mounting between said backing plate 24 and the carrier plate 22 is overcome, and thus the backing plate 24 and peripheral blocks 32, 34 connected thereto move relative to the carrier plate. The extent of relative displacement is shown by gaps 36, 38 which appear between these components. Before the arrangement is compressed by virtue of the contact of the base plate 16 against the thrust plate 8, the carrier plate 22 and the backing plate are prevented from be separated under the action of the springs by means of the shoulders 40, 42 provided around the outside of the carrier plate. Blocks 32, 34 are provided with grooves 32X, 34X which receive the uppermost edge of the tin box shell and exert a downward pressure through the walls of the shell into the groove 6. It is this operation which secures the end to the shell because the partial curl provided on the edge of the shell within the groove 6 is deformed into a complete curl around the corresponding formation on the end to encase same.

The cam component 30 is provided with a pair of primary inclined cam surfaces 44, 46 against which a pair of circular primary cam followers 48, 50 are biased and on which same can roll. The cam followers 48, 50 pivoted at 52, 54 on pins having axes which are substantially coplanar with the central horizontal axis 58 of both the mandrel and displacing rods 60, 62 in which the cam followers are pivoted.

In FIGS. 7–10, corresponding reference numerals are used for corresponding parts, but in the case of the latter figures the reference numerals are suffixed with an X to distinguish.

In the arrangement shown in FIG. 1C, the rods have been displaced outwardly and away from the mandrel notional centre to their maximum extent by virtue of the vertical displacement of the cam component 30. It is the displacement mechanism which is fundamental to the invention.

Referring now to FIG. 2, the displacement mechanism is applied to the various components of which the mandrel as a whole is comprised can be seen. In particular, the mandrel cross-sectional shape, of a rectangle in this instance, is defined by a pair of side wall portions 62, 64, and four corner portions 66, 68, 70, 72. The movement of each of said portions is ultimately effected by virtue of the vertical motion of the central cam component 30. This motion causes the outward displacement of the rods 60, 62 which are provided with secondary 74, 76, 78, 80 and tertiary 82, 84, 86, 88 inclined cam surfaces. Circular pivotally mounted cam followers 90, 92, 94, 96, 98, 100, 102, 104 are biased against these surfaces (or in the case of FIGS. 7–10, angled cam following surfaces 90X, 92X, 94X, 96X, 98X, 100X, 102X, 104X) such that the outward translation in a first horizontal direction 106 of the rods 60, 62 causes not only outward displacement of the sidewall portions 64, 66 in a second but perpendicular horizontal direction 108 but also displacement of the various corner portions 66, 68, 70, 72 in various directions all inclined at 45° to the first and second horizontal directions. The mathematics of the angles required to effect a uniform and un-distorted expansion of the various mandrel components is simple, and furthermore the implication which wear could have on the reliable long term operation of the device is minimal by virtue of the rolling cams.

Referring now to FIG. 3, the mechanism of expansion of the side wall portions 64, 66 is more clearly demonstrated. From this figure it is also clear that the rod 62 is substantially centrally provided within the mandrel block 2, and that said side wall portions are springingly mounted on dowels. Furthermore, it can also be seen that the thrust plate 8 is capable of slight vertical displacement relative to the carrier 12 so that both the end clamped between the lower surface 14 of the mandrel and said thrust plate and the shell disposed around the mandrel can move in unison during the completion of the seam which secures the end to said shell.

In FIG. 9, an alternative mounting arrangement for the side wall portions 64X, 66X is clearly shown. This arrangement is advantageous over that shown in FIGS. 1–4 because it has been found that the cap screws 95, 97 which connect the side wall portions 64, 66 to the cam follower arrangement in contact with the cam surfaces 78, 80 of the rod 62 shown in FIG. 3 have a tendency to shear off when the end of the tin box is incorrectly deposited within the tool prior to entry of the mandrel therein. For example, when one edge of an end catches on the upper edge of the shell within the tool, the end rests usually diagonally within the shell from one side to the other. As the mandrel is brought into the shell, it is moving initially relatively quickly (400 mm/s) as no hindrance to movement is expected. Obviously when the mandrel is almost fully inserted within the shell during conventional operation, it is moving considerably more slowly (35 mm/s as a significant force is applied therethrough). When the lower surface of one of the side wall portions contacts an incorrectly disposed end, the impact generated is often sufficient to shear the said cap screws.

Accordingly, a modified means of connection was devised, shown in FIG. 9, in which hollow dowels 120X, 122X, 124X, 126X are provided in the side wall portions 64X, 66X and expansible compression springs 128X are disposed through the said dowels. It is these extension of these compression springs which ensures that the side wall portions return to their retracted disposition after the rod 62X has receded within the mandrel. The side wall portions are urged outwardly by pegs 130X, 132X which communicate directly with the cam surfaces 78X, 80X. The absence of cap screws improves the longevity of the mandrel.

A similar arrangement for effecting motion of the corner portion 66 is shown in FIG. 10.

In FIG. 4, the displacement mechanism for the corner portion 66 is shown more clearly. The arrangement for the remaining corner portions is identical, and furthermore this arrangement functions in exactly the same manner as that for expanding the side wall portions.

As mentioned above, FIGS. 7–10 show essentially the same apparatus as that in FIGS. 1C–4, and therefore a specific description of the various parts is not repeated.

What is claimed is:

1. An expansible mandrel of a required depth having at least three side wall components movably coupled thereto and a movable base component, the outer surfaces of said side wall components defining a cross-sectional shape of said mandrel which it is desired to expand and contract in a predetermined manner, said base component mechanically communicating with said side wall components such that motion of said base in one direction causes motion of said side wall components in a direction perpendicular to said one direction to expand or contract said cross-sectional shape, wherein mechanical communication between base and side wall components is achieved through a primary cam component connected to said base component to be movable therewith and extending internally of said mandrel away from said base component and generally in the direction of movement thereof, said primary cam component having at least one cam surface on a side thereof remote from the connection with the base component and against which a cam follower of a secondary cam component bears, said secondary cam component having at least one cam surface against which a cam follower provided on one of said side wall components bears, the direction of motion of said secondary cam component being perpendicular to that of said primary cam component, and the direction of motion of said side wall components being perpendicular to that of the secondary cam component during expansion of the mandrel.

2. A mandrel according to claim 1 wherein the secondary cam component is disposed substantially at the mid point of the depth of the mandrel and is substantially parallel with the base component.

3. A mandrel according to claim 1 wherein the primary cam component is provided with a pair of cam surfaces, and two secondary cam components are disposed on either side of said primary cam component and orientated substantially perpendicular thereto, both being provided with cam followers bearing against the cam surfaces and capable of moving apart and towards each other when the primary cam component moves up and down within the mandrel.

4. A mandrel according to claim 3 wherein the cam surfaces and the cam followers are inclined to the longitudinal axes of said primary cam component and said secondary cam component respectively and are in parallel contact with each other such that the motion of the primary cam component causes wedging lateral displacement of said secondary cam components whose motion in turn causes wedging outward displacement of said side wall components.

5. A mandrel according to claim 4 wherein the secondary cam components are displaced laterally towards the extremities of the mandrel when the motion of the primary can component is vertically upward within said mandrel.

6. A mandrel according to claim 5 wherein the vertically upward motion of the base and the primary cam component, the concomitant lateral motion of the secondary cam components and the outward motion of the side wall components occurs against spring biasing means which ensure that the side wall components and the secondary cam components are returned to their original positions when the base of the mandrel is no longer forced inwardly thereof.

7. A mandrel according to claim 1 wherein said cam followers include rollers pivotally mounted in said secondary cam components and said side wall components which contact the cam surfaces of the primary cam component and of the secondary cam component respectively.

8. A mandrel according to claim 1 wherein the outward displacement of the side wall components is uniform ensuring that the cross-sectional shape of the mandrel is not distorted during expansion.

9. A mandrel according to claim 7 wherein the cam followers are circular, and the base component is separate from the base of the member.

10. A mandrel according to claim 3 wherein the cross-sectional shape of the mandrel is rectangular.

11. A mandrel according to claim 10 wherein the ends of the secondary cam components are provided with secondary cam surfaces on either side of the longitudinal axis of the secondary cam component, against which secondary cam followers are biased, said secondary cam followers being coupled to corner components to effect motion thereof in a diagonally outward direction during expansion of the mandrel.

* * * * *